US009895906B2

(12) United States Patent
Uchiyama

(10) Patent No.: US 9,895,906 B2
(45) Date of Patent: Feb. 20, 2018

(54) RECORDING DEVICE AND METHOD FOR CONTROLLING RECORDING DEVICE

(71) Applicant: SEIKO EPSON CORPORATION, Tokyo (JP)

(72) Inventor: Yuji Uchiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/731,763

(22) Filed: Jun. 5, 2015

(65) Prior Publication Data

US 2015/0266317 A1 Sep. 24, 2015

Related U.S. Application Data

(63) Continuation of application No. 14/099,265, filed on Dec. 6, 2013, now Pat. No. 9,073,352, which is a continuation of application No. 13/903,540, filed on May 28, 2013, now Pat. No. 8,628,162, which is a continuation of application No. 13/177,688, filed on Jul. 7, 2011, now Pat. No. 8,469,478.

(30) Foreign Application Priority Data

Jul. 20, 2010 (JP) ..... 2010-163020

(51) Int. Cl.
*B41J 29/38* (2006.01)
*B41J 11/00* (2006.01)

(52) U.S. Cl.
CPC ..... *B41J 11/0085* (2013.01); *B41J 11/0005* (2013.01)

(58) Field of Classification Search
CPC ..... B41J 11/0085
See application file for complete search history.

(56) References Cited

U.S. PATENT DOCUMENTS

| | | | | |
|---|---|---|---|---|
| 6,604,820 | B1 * | 8/2003 | Fukuda | 347/104 |
| 2002/0186291 | A1 | 12/2002 | Kanazawa et al. | |
| 2003/0085980 | A1 * | 5/2003 | Ishii et al. | 347/104 |
| 2007/0007473 | A1 * | 1/2007 | Kumagai | G03G 21/168 250/582 |
| 2007/0146457 | A1 * | 6/2007 | Kito | B41J 11/0035 347/101 |
| 2010/0141726 | A1 * | 6/2010 | Kawakami | B41J 11/0015 347/102 |

(Continued)

FOREIGN PATENT DOCUMENTS

JP 08-197799 A 8/1996

*Primary Examiner* — Matthew Luu
*Assistant Examiner* — Tracey McMillion
(74) *Attorney, Agent, or Firm* — Global IP Counselors, LLP

(57) ABSTRACT

A recording device includes a medium-supporting part having a suction hole, a recording head and a suction part. The recording head is configured and arranged to perform a liquid ejection onto a medium supported on the medium-supporting part. The suction part is connected to the medium-supporting part to suck outside air via the suction hole. A liquid ejection period in which the recording head performs the liquid ejection onto the medium has a first period in which the suction part sucks by a predetermined suction force, and a second period in which the suction part sucks by a suction force which is smaller than the predetermine suction force after the first period.

12 Claims, 8 Drawing Sheets

(56) References Cited

U.S. PATENT DOCUMENTS

| | | | | |
|---|---|---|---|---|
| 2010/0171782 | A1* | 7/2010 | Kado ..... | B41J 11/0005<br>347/16 |
| 2011/0050826 | A1 | 3/2011 | Katagami et al. | |

* cited by examiner

RECORDING DEVICE AND METHOD FOR CONTROLLING RECORDING DEVICE

CROSS-REFERENCE TO RELATED APPLICATIONS

This is a continuation application of U.S. patent application Ser. No. 14/099,265, filed on Dec. 6, 2013, which is a continuation application of U.S. patent application Ser. No. 13/903,540, filed on May 28, 2013, now U.S. Pat. No. 8,628,162, which is a continuation application of U.S. patent application Ser. No. 13/177,688, filed on Jul. 7, 2011, now U.S. Pat. No. 8,469,478. U.S. patent application Ser. No. 13/177,688 claims foreign priority to Japanese Patent Application No. 2010-163020 filed on Jul. 20, 2010. The entire disclosures of U.S. patent application Ser. Nos. 14/099,265, 13/903,540 and Ser. No. 13/177,688 and Japanese Patent Application No. 2010-163020 are hereby incorporated herein by reference.

BACKGROUND

Technical Field

The present invention relates to a recording device and a method for controlling a recording device.

In an inkjet printer or another recording device, when a recording process is performed on recording paper or another recording medium, the recording medium must be supported by a platen so as to have a certain alignment (parallel) with respect to a recording head.

Related Art

In conventional practice, a technique for avoiding the inconvenience caused by curling is provided, wherein, as a countermeasure against curling in the recording medium due to any cause, holding members composed of thin, resinous sheets are provided to both sides of the recording medium, and the recording medium is inserted into the gaps formed between the holding members and the medium-supporting surface of the platen (see Japanese Laid-Open Patent Application Publication No. 8-197799, for example).

SUMMARY

Particularly in cases in which roll paper is used as the recording medium, the ends of the roll paper rise up off the platen due to waviness (curling); therefore, a paper suction part for suctioning the roll paper to the platen is provided in order to keep the paper from rising.

In this paper suction part, typically, numerous suction holes are provided to the platen and outside air is drawn through the suction holes by a fan installed on the reverse surface of the platen, whereby the roll paper is held by suction (negative pressure suction) on top of the platen.

However, the conveying force is sometimes reduced by the roll paper being suctioned on top of the platen.

The present invention was devised in view of the matters described above, and an object thereof is to provide a recording device and a method for controlling a recording device whereby a recording medium can be held satisfactorily and conveyed smoothly.

A recording device according to one aspect includes a medium-supporting part having a suction hole, a recording head and a suction part. The recording head is configured and arranged to perform a liquid ejection onto a medium supported on the medium-supporting part. The suction part is connected to the medium-supporting part to suck outside air via the suction hole. A liquid ejection period in which the recording head performs the liquid ejection onto the medium has a first period in which the suction part sucks by a predetermined suction force, and a second period in which the suction part sucks by a suction force which is smaller than the predetermine suction force after the first period.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
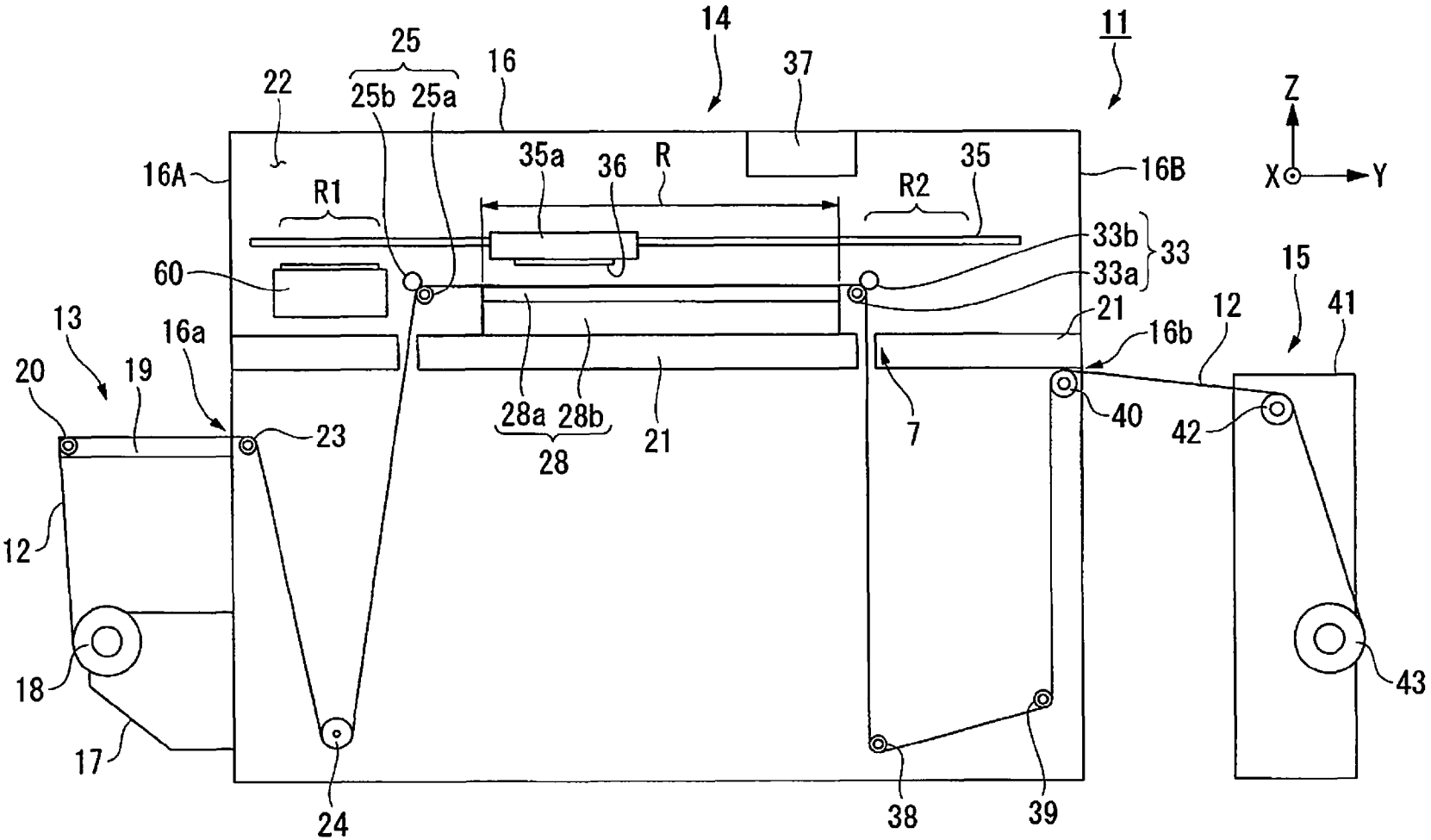
FIG. 1 is a diagram showing the schematic configuration of a printer of the embodiment.

An embodiment of the recording device is described hereinbelow using the drawings.

The scope of the present invention is not limited to the following embodiment, and desired modifications are possible within the range of the technological ideals of the present invention. To make the configurations easier to understand in the drawings hereinbelow, the scales, numbers, and other features of the structures are sometimes made to differ from the actual structure.

Figure 2:
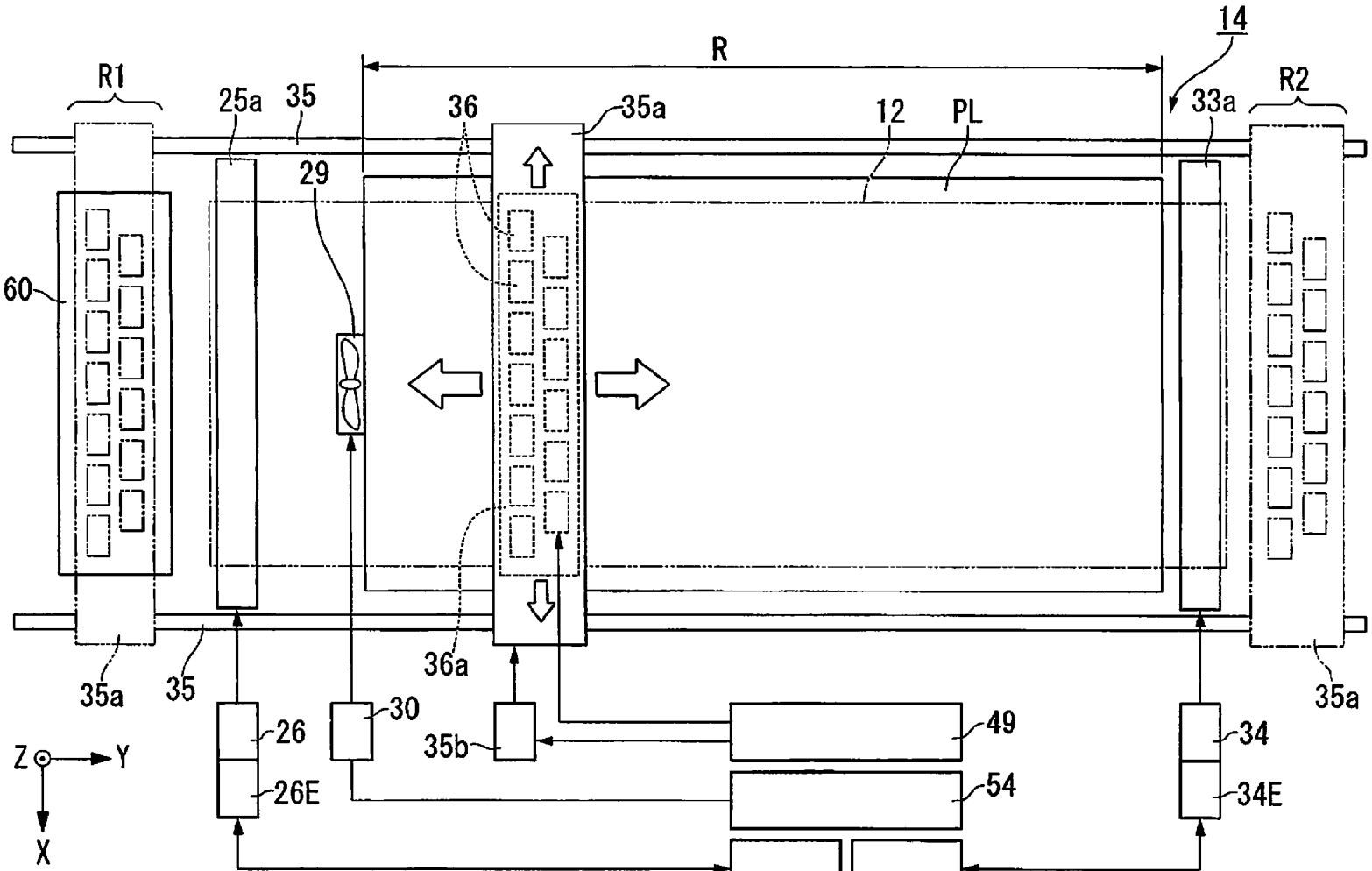
FIG. 2 is a plan view of the print area where printing is conducted in the printer.
Figure 3:
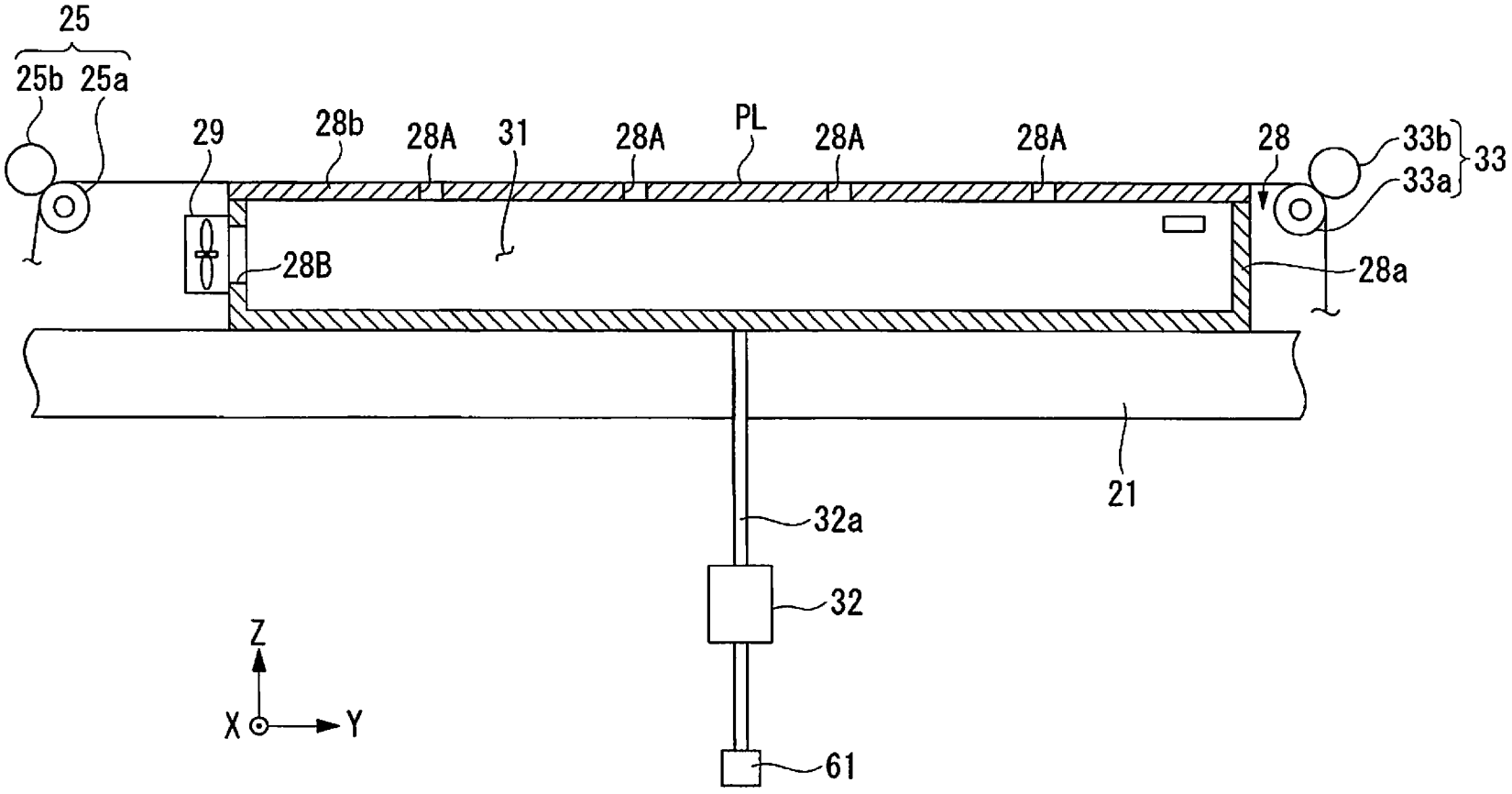
FIG. 3 is a cross-sectional view showing the schematic configuration of the entire printer.

FIG. 1 is a diagram showing the schematic configuration of the printer of the present embodiment. FIG. 2 is a plan view of the print area where printing is conducted in the printer. FIG. 3 is a cross-sectional view showing the schematic configuration of the entire printer.

A printer (recording device) 11 uses as a printing system an inkjet system for ejecting a liquid from a plurality of recording heads (liquid ejection heads) onto a continuous paper 12. The printer 11 performs the printing process while sequentially unreeling the long, rectangular continuous paper (the recording medium) 12 wound into a roll shape, and after printing, winds the continuous paper 12 back up into a roll shape.

In the present embodiment, there is employed an XYZ orthogonal coordinate system in which the width direction of the continuous paper 12 in a horizontal plane is the X direction, the conveying direction of the continuous paper 12 which is orthogonal to the X direction is the Y direction, and the vertical direction is the Z direction.

The printer 11 comprises a main body 14 for executing the printing process, an unreeling part 13 for supplying the continuous paper 12 to the main body 14, and a winding part 15 for winding up the continuous paper 12 discharged from the main body 14.

The main body 14 comprises a main body case 16. The unreeling part 13 is placed upstream in the conveying direction (−Y) from the main body case 16, and the winding part 15 is placed downstream in the conveying direction (+Y) from the main body case 16. The unreeling part 13 is connected to a medium supply part 16*a* provided to a side wall 16A on the upstream side in the conveying direction (−Y) of the main body case 16, while the winding part 15 is connected to a medium discharge part 16*b* provided to a side wall 16B on the downstream side in the conveying direction (+Y).

The unreeling part 13 comprises a support plate 17 attached to the bottom of the side wall 16A of the main body case 16, a winding shaft 18 provided to the support plate 17, an unreeling stand 19 connected to the medium supply part 16*a* of the main body case 16, and a relay roller 20 provided to the distal end of the unreeling stand 19. The continuous paper 12, which is wound into a roll shape, is rotatably supported on the winding shaft 18. When unreeled from the roll, the continuous paper 12 is wrapped over the relay roller 20, shifted to the top surface of the unreeling stand 19, and conveyed along the top surface of the unreeling stand 19 to the medium supply part 16*a*.

The winding part 15 comprises a winding frame 41, and a relay roller 42 and winding drive shaft 43 provided to the winding frame 41. The continuous paper 12 discharged from the medium-discharging part 16*b* is wrapped over the relay roller 42, guided to the winding drive shaft 43, and wound up into a roll shape by the rotatable driving of the winding drive shaft 43.

A plate-shaped base stand 21 is disposed horizontally within the main body case 16 of the main body 14, and the interior of the main body case is divided into two spaces by the base stand 21. The space above the base stand 21 is a printing chamber 22 for conducting the printing process on the continuous paper 12. The printing chamber 22 is provided with a platen (medium-supporting part) 28 fixed in place on the base stand 21, a recording head (recording processing part) 36 provided above the platen 28, a carriage 35*a* for supporting the recording head 36, two guide shafts 35 (see FIG. 2) for supporting the carriage 35*a*, and a valve unit 37. The two guide shafts 35 are arranged parallel to each other along the conveying direction (the Y direction), and are configured so as to enable the carriage 35*a* to move back and forth in the conveying direction.

The platen 28 has a box-shaped support stand 28*a* open in the top surface, and a carrying plate 28*b* attached to the opening of the support stand 28*a*, as shown in FIGS. 1 through 3. The support stand 28*a* is fixed in place on the base stand 21, and the interior enclosed by the support stand 28*a* and the carrying plate 28*b* constitutes a negative-pressure chamber 31. The continuous paper 12 is carried on a support surface (medium-supporting surface) PL (the top surface in the drawing) of the carrying plate 28*b*.

Formed in the carrying plate 28*b* are numerous suction holes 28A which pass through the thickness direction of the carrying plate 28*b*, and formed in one side wall of the support stand 28*a* (the −Y side wall in the present embodiment) is an exhaust port 28B which passes through this side wall. A suction fan (suction device) 29 is connected to the exhaust port 28B. The interior of the negative-pressure chamber 31 is suctioned by the suction fan 29, whereby suction force can be applied to the continuous paper 12 via the numerous suction holes 28A, and the continuous paper 12 can be suctioned to and kept flat against the support surface PL of the carrying plate 28*b*.

A pressure detection sensor 32 for detecting the pressure in the negative-pressure chamber 31 is connected to the platen 28. The pressure detection sensor 32 is arranged on a ventilation line 32*a* which is connected at one end to the bottom of the support stand 28*a* and connected at the other end to a vacuum source 61, and the pressure detection sensor 32 measures the air pressure in the negative-pressure chamber 31 supplied through the ventilation line 32*a*. The detection result thereof is then outputted to a suction fan motor driver (control part) 54 (FIG. 2).

A supply conveying system including a plurality of conveying rollers is provided to the upstream side in the conveying direction (−Y) of the platen 28. The supply conveying system includes a first conveying roller pair 25 provided in the printing chamber 22 near the platen 28, a relay roller 24 provided in the lower space of the main body case 16, and a relay roller 23 provided near the medium supply part 16*a*.

The first conveying roller pair 25 is composed of a first drive roller 25*a* and a first driven roller 25*b*. A first conveying motor 26 and a first encoder 26E are linked to the first drive roller 25*a* as shown in FIG. 2.

In the supply conveying system, the continuous paper 12 conveyed into the main body case 16 from the unreeling part 13 via the medium supply part 16*a* is wrapped over the first drive roller 25*a* from below via the relay rollers 23, 24, and nipped in the first conveying roller pair 25. With the rotation of the first drive roller 25*a* driven by the first conveying motor 26, the continuous paper is unreeled horizontally onto the support surface PL of the platen 28 from the first conveying roller pair 25.

A discharging conveying system including a plurality of conveying rollers is provided on the downstream side in the conveying direction (+Y) of the platen 28. The discharging conveying system includes a second conveying roller pair 33 provided on the side of the platen 28 opposite the first conveying roller pair 25, a reversal roller 38 and relay roller 39 provided in the lower space of the main body case 16, and a feed-out roller 40 provided near the medium-discharging part 16*b*.

The second conveying roller pair 33 is composed of a second drive roller 33*a* and a second driven roller 33*b*. A second conveying motor 34 and a second encoder 34E are linked to the second drive roller 33*a* as shown in FIG. 2. Since the second driven roller 33*b* is placed over the printed surface (the top surface) of the continuous paper 12, to avoid damage to the printed image, the second driven roller 33*b* may be configured to come in contact only with the widthwise (X direction) end edges of the continuous paper 12.

In the discharging conveying system, the second conveying roller pair 33 nipping the continuous paper 12 conveys the continuous paper 12 off of the platen 28 with the rotation of the second drive roller 33*a* driven by the second conveying motor 34. The continuous paper 12 unreeled from the second conveying roller pair 33 is conveyed to the feed-out roller 40 via the reversal roller 38 and the relay roller 39, and is unreeled to the winding part 15 via the medium-discharging part 16*b* by the feed-out roller 40.

In the present embodiment, a plurality of recording heads 36 are attached to the carriage 35*a* via a head attachment plate 36*a*. The head attachment plate 36*a* is configured to be capable of moving over the carriage 35*a* in the medium width direction (the X direction). The position of the head attachment plate 36*a* can be controlled by a head position control part 35*b* connected to the carriage 35*a*, and the plurality of recording heads 36 can be integrally moved to a new line by moving the head attachment plate 36*a* in the medium width direction (the X direction). The recording heads 36 are arranged on the head attachment plate 36*a* in alignment at constant intervals in the medium width direction so that adjacent recording heads 36 are in two different levels from each other in the medium conveying direction (the Y direction).

The head position control part 35*b* can perform position control of the recording heads 36 in the medium width direction (the X direction) as well as position control of the carriage 35*a* in the medium conveying direction (the Y direction; the head scanning direction), and can place the recording heads 36 in the desired position over the continuous paper 12.

The plurality of recording heads 36 are connected with the valve unit 37 via respective ink supply tubes (not shown). The valve unit 37 is provided to the inner wall of the main body case 16 inside the printing chamber 22 and is connected with an ink tank (ink retention part, not shown). The valve unit 37 supplies ink to the recording heads 36 while temporarily retaining the ink supplied from the ink tank.

On the bottom surfaces (nozzle formation surfaces) of the recording heads 36, numerous ink discharge nozzles are arrayed in the medium width direction (the X direction). The recording heads 36 eject the ink supplied from the valve unit 37 from the ink discharge nozzles onto the continuous paper 12 on the platen 28 and perform printing.

The recording heads 36 may also have a plurality of ink discharge nozzle rows. In this case, when four-color or six-color printing is to be performed, if ink is allocated for each color to the respective ink discharge nozzle rows, a plurality of colors of ink can be ejected by a single recording head 36.

The area above the platen 28 in the printing chamber 22 is a printing area R where printing is performed on the continuous paper 12 by the ejection of ink from the ink discharge nozzles. The continuous paper 12 is conveyed intermittently by the supply conveying system and the discharging conveying system described above. Specifically, a length of continuous paper 12 equivalent to the printing area R is loaded onto the platen 28 every time printing is performed, and is fed out to the discharging conveying system after the printing process.

The guide shafts 35 extending into the printing chamber 22 extend outward in the medium conveying direction past the printing area R as shown in FIGS. 1 and 2. The carriage 35*a* is thereby capable of moving to an area outside of the printing area R. A first maintenance area R1 is provided to the upstream side in the medium conveying direction (−Y) of the printing area R, and a second maintenance area R2 is provided to the downstream side in the medium conveying direction (+Y).

The first maintenance area R1 is provided with a maintenance unit 60. The maintenance unit 60 is configured comprising, for example, cap members and wiping members provided in correspondence to the individual recording heads 36, and a suction device which is connected to the cap members and which suctions out the interiors of the cap members.

The second maintenance area R2 is not provided with any maintenance units or the like, but is a workspace into which technicians can place their hands and arms. By placing the carriage 35*a* in the second maintenance area R2, the nozzle formation surfaces of the recording heads 36 can be exposed in the aforementioned workspace, and the nozzle formation surfaces can be wiped or the recording heads 36 can be replaced by the technicians.

After the printing process, the continuous paper 12 is naturally dried while being conveyed through the discharging conveying system, but the configuration may also comprise a heating device for forcefully drying the ink and causing the ink to adhere to the continuous paper 12. For example, the configuration may provide the platen 28 with a platen heater for heating the carrying plate 28*b*, or the configuration may have a heating device provided within the discharging conveying system.

Figure 4:
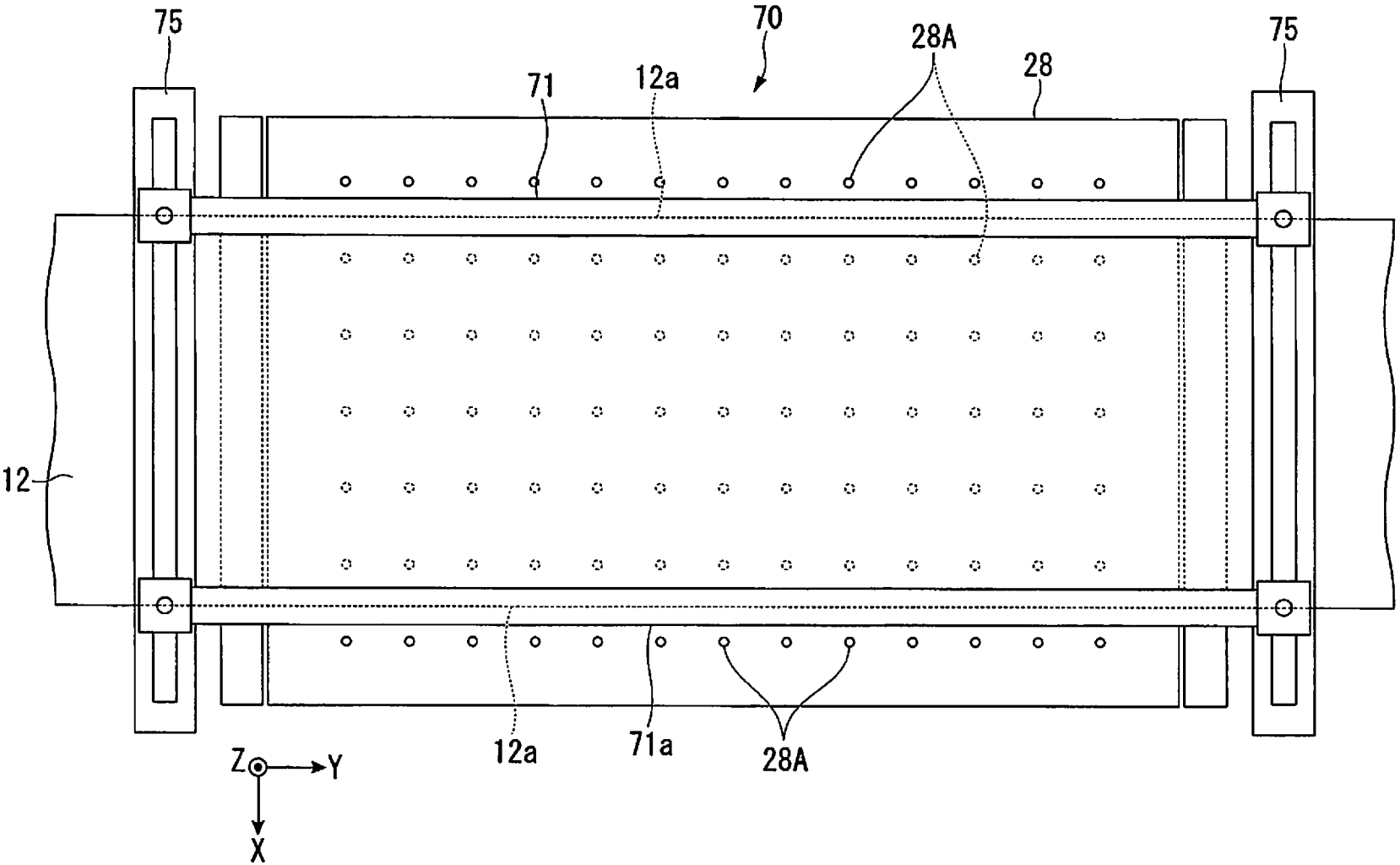
FIG. 4 is a plan view showing the schematic configuration of the platen.

FIG. 4 is a plan view showing the schematic configuration of the platen.

Suction holes 28A, composed of numerous through-holes approximately several millimeters in inside diameter, for example, are formed throughout substantially the entire surface of the platen 28 as shown in FIG. 4. Specifically, suction holes 28A having inside diameters of 2 to 3 mm are formed in aligned rows in both the longitudinal direction (the conveying direction of the continuous paper 12) and the width direction (the direction orthogonal to the conveying direction) of the platen 28.

The negative-pressure chamber 31 is an airtight space whose ceiling is the platen 28, and the bottom surface of this chamber is provided with a plurality of suction fans 29. The suction fans 29 are used to suction out the air in the negative-pressure chamber 31 to create negative pressure. Outside air is thereby suctioned out via the numerous suction holes 28A formed in the platen 28, and the continuous paper 12 carried on the surface (the top surface) of the platen 28 is held by suction to the surface of the platen 28.

A curling suppressor 70 holds the side ends 12*a* of the continuous paper 12 carried on the surface of the platen 28 down on the platen 28, thereby preventing so-called rising in which the side ends 12*a* of the continuous paper 12 curl and separate from the platen 28.

Specifically, the curling suppressor 70 comprises curl-suppressing members 71 composed of a pair of soft and flexible belt-shaped films. The curl-suppressing members 71 each have a thickness of, for example, 0.5 mm or less, and a width of about 30 mm. Polyimide or the like, for example, can be used for the material.

The ends of the curl-suppressing members 71 (the ends in the length direction) are linked to curl-suppressing attachment parts 75 fixed in place to a base (not shown) of the printer 11. The curl-suppressing attachment parts 75 are linked so as to be capable of moving the curl-suppressing members 71 toward and away from each other. Therefore, the side ends 12*a* on both widthwise sides of the continuous paper 12 carried on the top surface of the platen 28 can be held down across the entire length carried on the platen 28.

Figure 5:
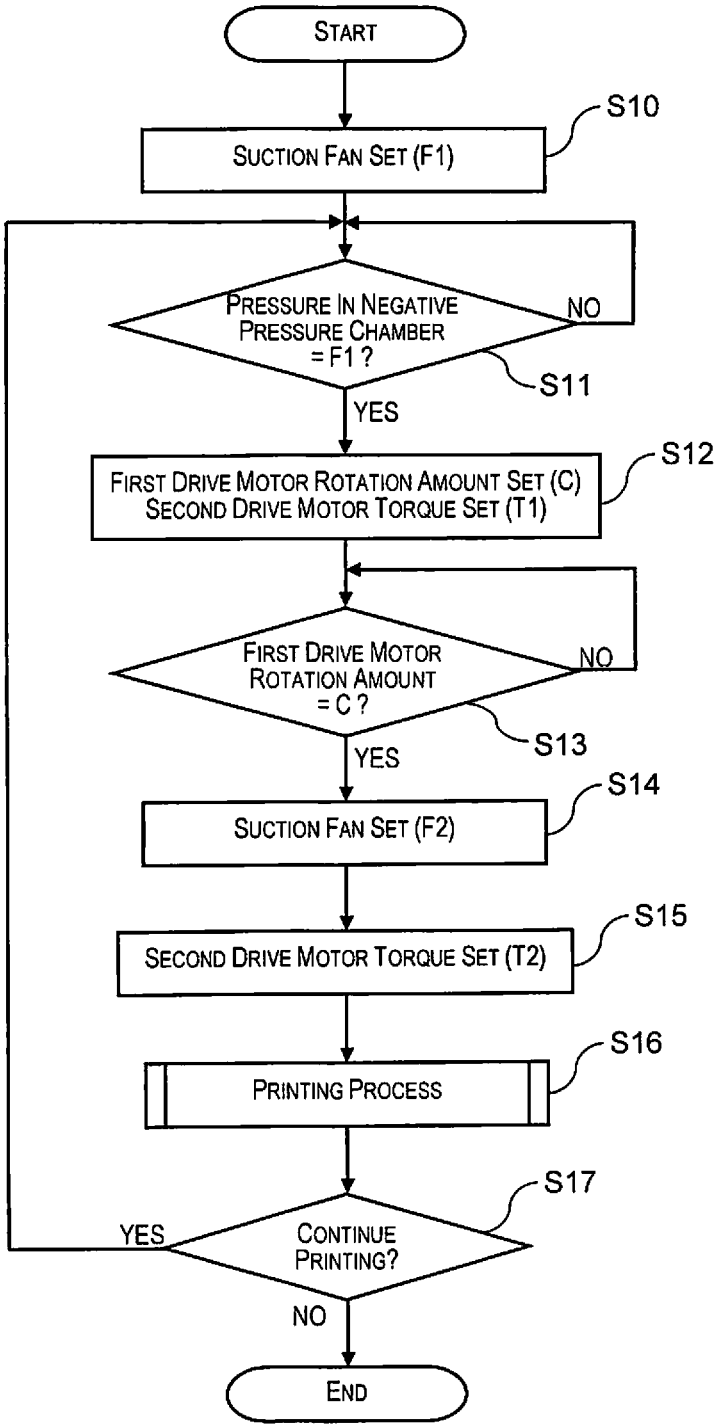
FIG. 5 is a flowchart showing the process routine pertaining to the conveying process and the printing process.
Figure 6:
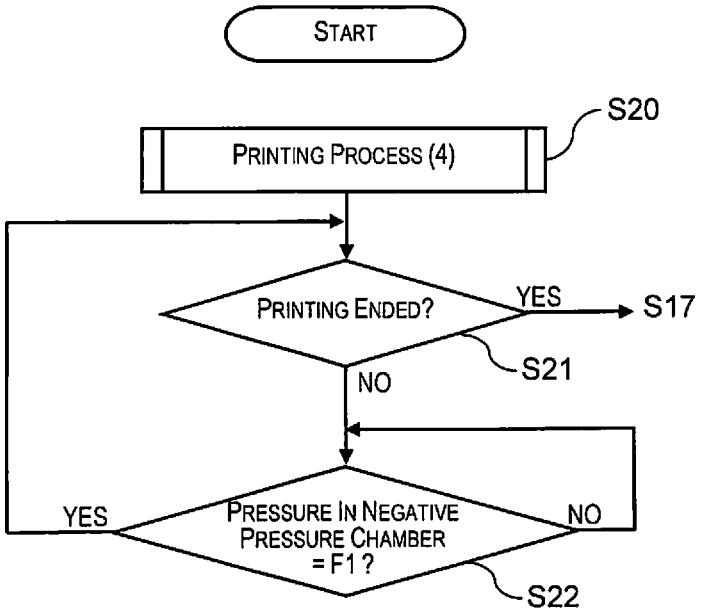
FIG. 6 is a diagram showing the printing process routine.
Figure 7:
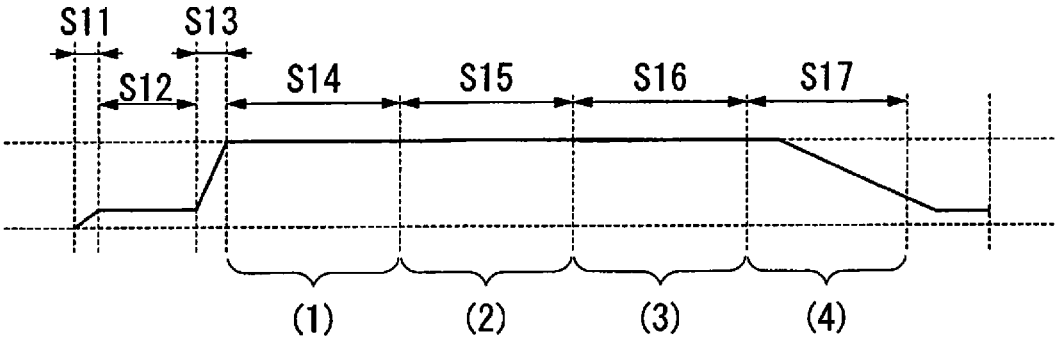
FIG. 7 is a diagram showing the suction sequence caused by the suction fan.
Figure 8A:
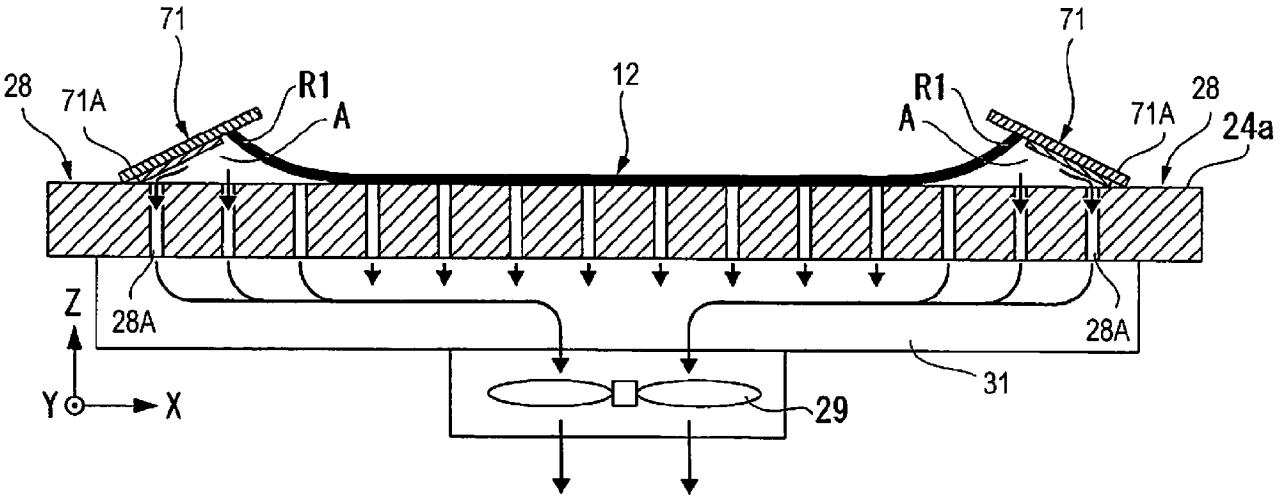
FIGS. 8A and 8B are diagrams showing the depressurized state caused by the suction fan in the negative-pressure chamber.
Figure 8B:
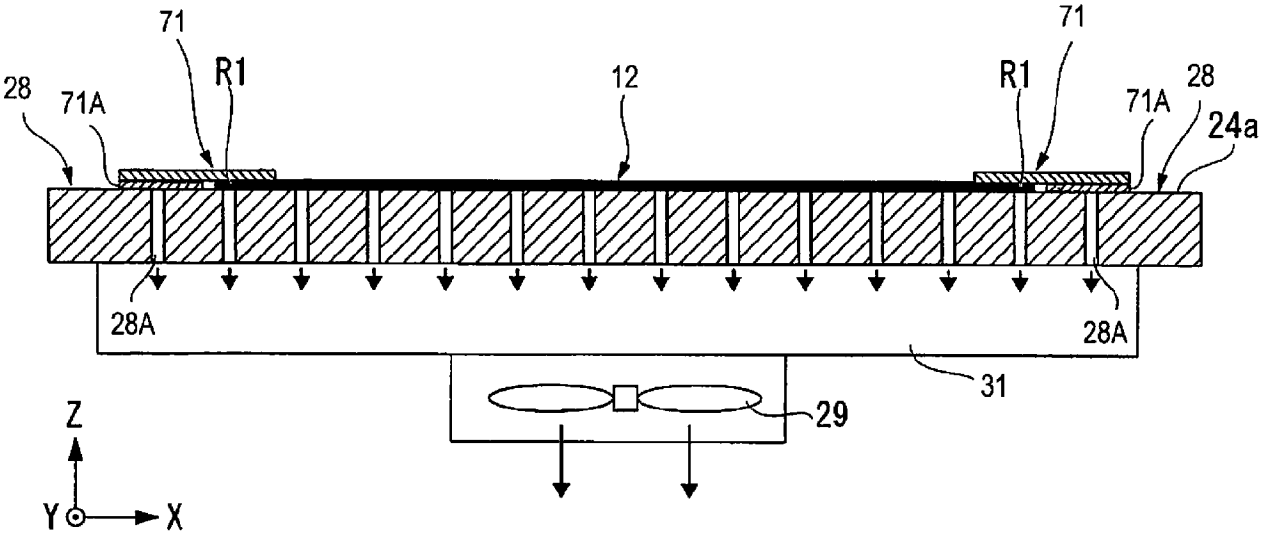
Figure 9:
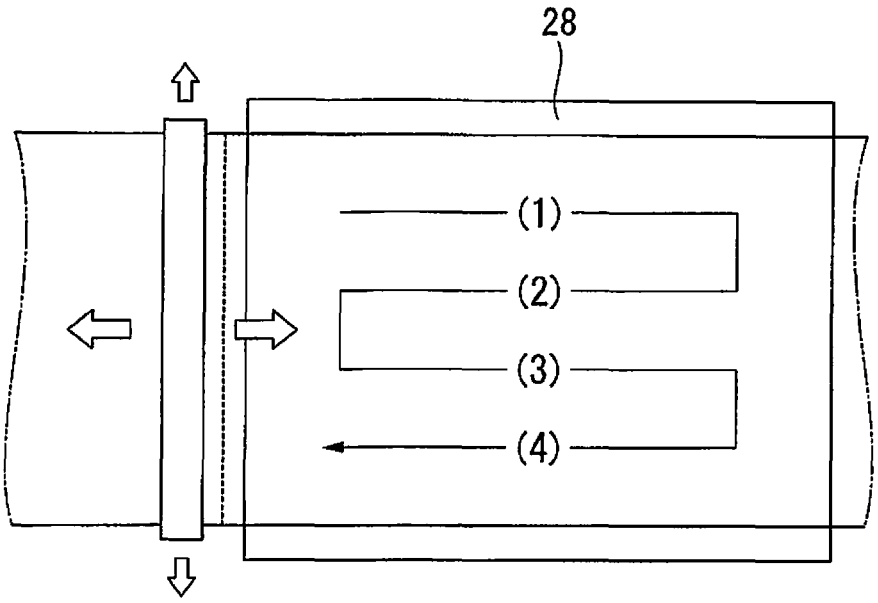
FIG. 9 is a diagram for describing the scanning action of the carriage.

Next, conveying control and printing control in the printer 11 of the present embodiment will be described with reference to FIGS. 5 through 9. FIG. 5 is a flowchart showing the process routine pertaining to the conveying process and the printing process. FIG. 6 is a diagram showing the printing process routine. FIG. 7 is a diagram showing the suction sequence caused by the suction fan. FIG. 8 is a diagram showing the depressurized state in the negative-pressure chamber caused by the suction fan. FIG. 9 is a diagram for describing the scanning action of the carriage.

Suction for Conveying

First, in step S10, a controller 44 sets the suction force in the negative-pressure chamber 31 due to the suction fan 29 to F1 (a first suction force) by setting the rotational speed of the suction fan motor 30.

The controller 44 then sends a control signal to the suction fan motor driver (control part) 54. Negative pressure (−140 Pa) is thereupon created in the negative-pressure chamber 31 by the suction fan 29 beginning to be rotatably driven along with the rotatable driving of the suction fan motor 30, and outside air is drawn in from the numerous suction holes 28A formed in the platen 28 (FIG. 8A). As a result, a suction-holding force acts on the continuous paper 12 on the support surface PL of the platen 28 from within the negative-pressure chamber 31 via the suction holes 28A. In this case, the continuous paper 12 is held by suction on the support surface PL of the platen 28 by a first suction-holding force substantially equal to the suction force F1 of the suction fan 29 (FIG. 8B).

Next, in step S11, based on the detection signal from the pressure detection sensor (the pressure detection part) 32 connected to the platen 28 (the negative-pressure chamber 31), the controller 44 determines whether or not the pressure in the negative-pressure chamber 31 has been reduced to a pressure value substantially equal to the suction force F1 of the suction fan 29 with the rotatable driving of the suction fan 29.

When the determination result in step S11 is a positive determination (the pressure of the negative-pressure chamber 31 equals F1), the controller 44 concludes that depressurization by the suction fan 29 of the pressure in the negative-pressure chamber 31 to the desired pressure value is complete, and the process transitions to step S12.

When the determination result in step S11 is a negative determination (the pressure of the negative-pressure chamber 31 does not equal F1), the controller 44 concludes that depressurization in the negative-pressure chamber 31 by the suction fan 29 is not complete. The controller 44 continues depressurization in the negative-pressure chamber 31 by the suction fan 29 so that the pressure in the negative-pressure chamber 31 is reduced to the desired pressure value.

Conveying Operation

Next, in step S12, the controller 44 sets the amount the continuous paper 12 will be conveyed by the first drive roller 25*a* by setting the rotation amount of the first conveying motor 26 to C. The rotation amount C of the first conveying motor 26 is set so that when the first drive roller 25*a* is rotatably driven along with the rotatable driving of the first conveying motor 26, the amount the continuous paper 12 is conveyed by the first drive roller 25*a* is equal to a distance corresponding to the printing area R from the left end to the right end of the platen 28 in the conveying direction.

The controller 44 sets the strength of the tensile force applied to the continuous paper 12 from the second drive roller 33*a* by setting the managed torque value of the second conveying motor 34 to T1. The managed torque value T1 of the second conveying motor 34 is set so that the strength of the tensile force applied to the continuous paper 12 on the platen 28, which is applied by the second drive roller 33*a* based on the torque of the second conveying motor 34, reaches a strength capable of sufficiently minimizing flapping of the continuous paper 12 during conveying.

Next, the controller 44 sends a control signal to the first conveying motor driver 50 and the second conveying motor driver 52. The first drive roller 25*a* thereupon begins to be rotatably driven along with the rotatable driving of the first conveying motor 26, and the first drive roller 25*a* thereby conveys the continuous paper 12. At the same time, the second drive roller 33*a* begins to be rotatably driven along with the rotatable driving of the second conveying motor 34, and the second drive roller 33*a* thereby applies tensile force to the continuous paper 12.

The continuous paper 12 is sequentially wound up by the winding drive shaft 43 even when pulled downstream in the conveying direction from off of the support surface PL of the platen 28 by the second drive roller 33*a*. Therefore, the continuous paper 12 substantially does not warp at the position downstream in the conveying direction from the second drive roller 33*a*, and the continuous paper 12 is therefore conveyed in a stable manner along the conveying route by the first drive roller 25*a*.

While the continuous paper 12 is being conveyed, the controller 44 is constantly observing the rotation amount of the first drive roller 25*a* based on a detection signal from the rotation amount detection sensor 51, constantly observing the strength of the tensile force applied to the continuous paper 12 from the second drive roller 33*a* based on a detection signal from the torque detection sensor 53, and also constantly observing the pressure change in the negative-pressure chamber 31 accompanying the rotatable driving of the suction fan 29 based on a detection signal from the pressure detection sensor 32.

The rotational speed of the second drive roller 33*a* is set to be higher than the rotational speed of the first drive roller 25*a*. Therefore, the second drive roller 33*a* applies tensile force to the continuous paper 12 while it is being conveyed, and the flatness of the continuous paper 12 on top of the platen 28 is thereby improved.

The suction force F1 of the suction fan 29 is set to a strength that does not cause the continuous paper 12 to stick firmly to the support surface PL of the platen 28, so as to not impede the conveying of the continuous paper 12 by the first drive roller 25*a*. In the present embodiment, this suction force is set to −140 Pa.

Therefore, tensile force is reliably applied by the second drive roller 33*a* to the continuous paper 12 on the support surface PL of the platen 28, and it is therefore possible to adjust with high precision the strength of the tensile force applied to the continuous paper 12 from the second drive roller 33*a*. The suction-holding force applied to the continuous paper 12 from the support surface PL of the platen 28 is weak, therefore avoiding excessive drive loads in the first conveying motor 26 and the second conveying motor 34 when the continuous paper 12 is being conveyed.

Additionally, in the present embodiment, the suction force F1 of the suction fan 29 and the managed torque value T1 of the second conveying motor 34 can be modified as desired based on data inputted to the controller 44 from the external input device 48. Therefore, by setting the suction force F1 of the suction fan 29 to a lower value, the managed torque value T1 of the second conveying motor 34 can be set to a lower value within a range in which flapping of the continuous paper 12 during conveying can be minimized. By setting the managed torque value T1 of the second conveying motor 34 to a lower value, the drive load of the second conveying motor 34 is reduced, the second conveying motor 34 can therefore be prevented from overheating, and energy can be conserved in the entire device.

Next, in step S13, the controller 44 determines whether or not the rotation amount of the first conveying motor 26 has reached the rotation amount C set in step S12, based on a detection signal from the rotation amount detection sensor 51.

When the determination result in step S13 is a positive determination (the rotation amount of the first conveying motor 26 is equal to C), the controller 44 concludes that the conveying of the continuous paper 12 by the first drive roller 25*a* is complete, the conveyed amount of the continuous paper 12 having reached the desired conveyed amount, and the process transitions to step S14.

When the determination result in step S13 is a negative determination (the rotation amount of the first conveying motor 26 does not equal C), the controller 44 concludes that the conveying of the continuous paper 12 by the first drive roller 25*a* is not complete. The controller 44 continues the conveying of the continuous paper 12 by the first drive roller 25*a* until the conveyed amount of the continuous paper 12 by the first drive roller 25*a* reaches the desired conveyed amount.

Next, in step S14, the controller 44 modifies the suction force generated in the negative-pressure chamber 31 by the suction fan 29 to F2 (second suction force: −530 Pa), by setting the rotational speed of the suction fan motor 30. The suction force F2 of the suction fan 29 is set to a greater value than the suction force F1 (−140 Pa) of the suction fan 29 set in step S10. A predetermined negative pressure can thereby be generated in the negative-pressure chamber 31.

The continuous paper 12 is then held by suction on the support surface PL of the platen 28 by a second suction-holding force, which is substantially equal to the suction force F2 of the suction fan 29. Specifically, the suction fan 29 causes the continuous paper 12 to be held to the support surface PL of the platen 28 by the second suction-holding force when the printing process is being executed, and causes the continuous paper 12 to be held to the support surface PL of the platen 28 by the first suction-holding force, which is less than the second suction-holding force, when the conveying process is being executed.

The controller 44 transmits a control signal to the suction fan motor driver 54. The rotational speed of the suction fan motor 30 is thereupon modified so as to decrease, whereby the negative pressure created in the negative-pressure chamber 31 along with the driving of the suction fan 29 changes quickly from −140 Pa to −580 Pa. As a result, the continuous paper 12 on the support surface PL of the platen 28 is held on the support surface PL of the platen 28 by a suction-holding force substantially equal to the suction force F2 of the suction fan 29.

In this case, a relatively strong suction-holding force acts on the continuous paper 12 which has stopped being conveyed on top of the support surface PL of the platen 28, therefore eliminating wrinkles and the like in the continuous paper 12 and maintaining flatness on the support surface PL of the platen 28. Due to the continuous paper 12 being held by suction on the platen 28, there is virtually no positional misalignment on the support surface PL.

Next, in step S15, the controller 44 modifies the strength of the tensile force applied to the continuous paper 12 from the second drive roller 33*a* by setting the managed torque value of the second conveying motor 34 to T2. The managed torque value T2 of the second conveying motor 34 is set to a smaller value than the managed torque value T1 of the second conveying motor 34 set in step S12.

Next, the controller 44 transmits a control signal to the second conveying motor driver 52. The strength of the torque transmitted from the second conveying motor 34 to the second drive roller 33*a* is thereupon modified, thereby changing the strength of the tensile force applied to the continuous paper 12 by the second drive roller 33*a*. In this case, a relatively small tensile force is applied to the continuous paper 12 from the second drive roller 33*a* while the continuous paper 12 has stopped being conveyed. Therefore, the drive load of the second conveying motor 34 rotatably driving the second drive roller 33*a* is reduced, and energy is conserved in the entire device.

In the present embodiment, the controller 44 reduces the managed torque value of the second conveying motor 34 to T2 in step S15 after increasing the strength of the suction force of the suction fan 29 to F2 in step S14. Specifically, since the suction force of the suction fan 29 is increased while the strength of the tensile force applied to the continuous paper 12 from the second drive roller 33*a* is relatively large, the continuous paper 12 is held by suction on the support surface PL of the platen 28 while a high degree of flatness is maintained. Therefore, since the continuous paper 12 is held by suction firmly on the support surface PL of the platen 28 even when the strength of the tensile force applied to the continuous paper 12 from the second drive roller 33*a* has been reduced, there is virtually no positional misalignment in the continuous paper 12 on the support surface PL of the platen 28.

Next, in step S16, the controller 44 reads the print data relative to the continuous paper 12 from RAM (not shown), and transmits the read print data to a head driver 49. The head driver 49 thereupon initiates the printing action on the continuous paper 12 by causing ink to be ejected from the ink discharge nozzles of the recording head 36 onto the continuous paper 12 supported on the support surface PL of the platen 28. Specifically, the recording head 36 is designed to execute the printing process on the continuous paper 12 in between rotating actions of the first drive roller 25*a* caused intermittently by the first conveying motor driver 50.

At this time, the continuous paper 12 positioned on the support surface PL of the platen 28 is reliably suctioned flat across the entire width direction, and the recording head 36 can therefore conduct a high-quality printing process on the continuous paper 12 which is kept flat.

In the present embodiment, as described above, printing is conducted on a predetermined area (the printing area R set in correspondence with the size of the platen 28) of the continuous paper 12 kept flat on the platen 28. In practice, as shown in FIG. 9, a predetermined printing is conducted on the continuous paper 12 by advancing the plurality of recording heads 36 integrally to the next line while moving the carriage 35*a* in the conveying direction of the continuous paper 12 and also moving the carriage 35*a* in the width direction (the X direction) of the continuous paper 12. While the carriage 35*a* is advanced a plurality of times (three times) to the next line in the width direction (the X direction) of the continuous paper 12, the carriage 35*a* is moved back and forth along the conveying direction (the Y direction) of the continuous paper 12 in the following sequence: first scan (1)→second scan (2)→third scan (3)→fourth scan (4). The scans are conducted approximately every two seconds.

In this manner is printing conducted on the continuous paper 12 held by suction flat on the platen 28.

In the present embodiment, the pressure inside the negative-pressure chamber 31 is changed while the printing process is being executed.

First, the interior of the negative-pressure chamber 31 having reached a predetermined negative pressure (−580 Pa) due to the suction fan 29 being rotatably driven, the carriage 35*a* is repeatedly moved back and forth along the conveying direction of the continuous paper 12 and advanced to the next line in the width direction of the continuous paper 12, thereby scanning in the sequence first scan (1)→second scan (2)→third scan (3), and conducting printing (step S20).

In the fourth scan (4), printing is performed while the carriage 35*a* is moved from the downstream side in the conveying direction of the continuous paper 12 to the upstream side in the conveying direction (step S21). With a predetermined timing during the fourth scan (4), the controller 44 then sets the suction force in the negative-pressure chamber 31 caused by the suction fan 29 to F1 by setting the rotational speed of the suction fan motor 30 (step S22). The controller 44 then transmits a control signal to the suction fan motor driver 54 and lessens the drive force of the suction fan motor 30 to gradually reduce the rotational speed of the suction fan 29. The timing in which the drive force of the suction fan motor 30 is lessened is set as appropriate.

The controller 44 transmits to the suction fan motor driver 54 a control signal for changing the rotational speed of the suction fan motor 30. Specifically, a control signal which incrementally reduces the rotational speed of the suction fan motor 30 is transmitted to the suction fan motor driver 54 until the suction force whereby the interior of the negative-pressure chamber 31 is suctioned by the suction fan 29 changes from F2 to F1. The rotational speed of the suction fan motor 30 thereupon gradually decreases, and the pressure in the negative-pressure chamber 31 changes (increases) accordingly.

The controller 44 then makes a conclusion as to whether or not the printing process on the predetermined area in the continuous paper 12 has ended (step S23), and when the printing process is concluded to have ended, the process transitions to step S17.

Next, in step S17, the controller 44 makes a conclusion as to whether or not to continue the printing process on the continuous paper 12. When the controller 44 determines to continue the printing process on the continuous paper 12 in step S17, the process returns to step S11, and based on a detection signal from the pressure detection sensor 32, a determination is made as to whether or not the pressure in the negative-pressure chamber 31 has increased to a pressure substantially equal to the suction force F1 of the suction fan 29 with the reduction in the rotational speed of the suction fan 29.

When the determination result in step S11 is a positive determination (the pressure in the negative-pressure chamber 31 equals F1), the controller 44 concludes that the pressure in the negative-pressure chamber 31 has increased to a maximum pressure value in the conveying of the continuous paper 12. The process then transitions to step S21, and when it is concluded in step S21 that printing on the printing area of the continuous paper 12 has ended, the process transitions to step S17.

When the determination result in step S22 is a negative determination (the pressure in the negative-pressure chamber 31 does not equal F1), the controller 44 concludes that the pressure in the negative-pressure chamber 31 has not reached the maximum pressure value in the conveying of the continuous paper 12. The controller 44 then progressively reduces the rotational speed of the suction fan 29 until the pressure in the negative-pressure chamber 31 reaches a pressure substantially equal to the suction force F1 of the suction fan 29, and the pressure in the negative-pressure chamber 31 is increased to a predetermined pressure value (about −140 Pa).

The controller 44 then observes the pressure in the negative-pressure chamber 31 according to the pressure detection sensor 32 until the determination result in step S11 is a positive determination.

Thus, when the printing process is continued, the process from step S11 to step S17 is reflexively executed.

When the controller 44 determines not to continue the printing process on the continuous paper 12 in step S17, the process routine programs pertaining to the conveying process and the printing process for the continuous paper 12 are ended.

As described in detail above, in the printer 11 of the present embodiment, the pressure in the negative-pressure chamber 31 is reduced until it reaches a value substantially equal to the suction force F2 of the suction fan 29 along with the rotational driving of the suction fan 29, and the printing process is thereby conducted on the continuous paper 12 after the continuous paper 12 supplied onto the platen 28 is held by suction on the support surface PL of the platen 28.

Since the continuous paper 12 which has been supplied onto the platen 28 and has stopped being conveyed is subjected to a suction-holding force that is relatively greater than that during conveying on the support surface PL of the platen 28, wrinkles and the like in the continuous paper 12 are eliminated and flatness is maintained on the support surface PL of the platen 28. Consequently, the recording head 36 can conduct the printing process on the predetermined area of the continuous paper 12 in which flatness is maintained on the platen 28, making high-quality printing possible.

Before the end of the printing process on the predetermined area of the continuous paper 12 carried on the platen 28, the rotational speed of the suction fan 29 is reduced to lower the suction force F2 of the suction fan 29 to the suction force F1 during conveying of the continuous paper 12. After the predetermined printing process has ended, the continuous paper 12 can begin to be conveyed at a faster timing than when the rotational speed of the suction fan 29 is reduced to lower the suction force F2 of the suction fan 29 to the suction force F1 during conveying of the continuous paper 12 and the pressure in the negative-pressure chamber 31 is increased to the predetermined pressure value (the pressure value during conveying: −140 Pa).

The timing with which the rotational speed of the suction fan 29 is reduced is not limited to the timing described above. When the printing process is being executed, the printer 11 of the present embodiment causes the continuous paper 12 to be held on the support surface PL of the platen 28 by the second suction-holding force (the suction force F2) which is relatively greater than that during the conveying process, and when the conveying process is executed, the printer 11 causes the continuous paper 12 to be held on the support surface PL of the platen 28 by the first suction-holding force (the suction force F1) which is less than the second suction-holding force during the printing process. After the portion of the continuous paper 12 supplied onto the platen 28 has been firmly held by suction and flattened on the support surface PL of the platen 28, the flatness is thereafter maintained even if the suction-holding force is lessened. Therefore, after the continuous paper 12 is held by the second suction-holding force on the platen 28, the rotational speed of the suction fan 29 may be incrementally lowered to lessen the suction force at a predetermined timing during any of the first through third scans (1) to (3).

It is difficult for outside air to be drawn in from the continuous paper 12 via the suction holes 28A positioned below the continuous paper 12, on which ink has been embedded by the printing process. Consequently, the suction holding of the continuous paper 12 onto which ink has been supplied by the printing process involves the gravity of the ink and the suction force applied to the continuous paper 12 via the numerous suction holes 28A of the platen 28 is increased by the presence of the ink, the result of which is that the flatness of the continuous paper 12 is maintained even when the suction-holding force on the continuous paper 12 is lessened. In other words, because of the abundant moisture after printing, there is less air leakage than in the dry portions (the non-printed portions) and the suction-holding force is greater.

Consequently, if the printing process has not yet ended, the rotational speed of the suction fan 29 may be reduced with any timing.

After the printing process has ended, when the rotational speed of the suction fan 29 is reduced in order to lessen the depressurized state of the negative-pressure chamber 31, it takes time for the pressure to reach a predetermined pressure value. When conveying is begun before the pressure of the negative-pressure chamber 31 reaches the predetermined pressure value, the continuous paper 12 undergoes stress and the conveying speed decreases.

Therefore, after the printing process has ended, the conveying process is conducted after the pressure in the negative-pressure chamber 31 reaches the predetermined pressure value (the suction force F1).

The pressure in the negative-pressure chamber 31 is brought to the predetermined pressure value by reducing the rotational speed of the suction fan 29, but the suction fan 29 may be stopped before the suction force of the suction fan 29 reaches F1. Since it is considered possible that after the suction fan 29 has stopped, outside air could continue to be drawn in via the suction holes 28A, applying suction-holding force to the continuous paper 12 until the state of depressurization in the negative-pressure chamber 31 is somewhat lessened; the rotational driving of the suction fan 29 may be stopped ahead of the completion of the printing process.

No matter what timing during the printing process is used to reduce the rotational speed of the suction fan 29, if the rotational speed of the suction fan 29 is controlled so that the suction-holding force during conveying (the suction force F1) is reached at the same time that the printing process (the first through fourth scans (1) to (4) of the recording head 36) ends, conveying of the continuous paper 12 can be initiated immediately after the printing process ends.

Consequently, while flatness on the platen 28 is maintained during the printing process, the continuous paper 12 can be quickly conveyed with a small amount of drive force by lessening the suction-holding force during conveying to reduce the conveying load on the continuous paper 12. If an attempt is made to convey the continuous paper 12 while it is still being firmly held by suction on the platen 28, the stress on the continuous paper 12 increases and it becomes difficult to convey the paper quickly.

The platen 28 may be provided with an atmosphere opening valve for opening the interior of the negative-pressure chamber 31 to the atmosphere. The degree of depressurization in the negative-pressure chamber 31 can be quickly reduced by using both the atmosphere opening valve and suction force adjustment by the suction fan 29, and conveying of the continuous paper 12 can be initiated with a faster timing.

Instead of the pressure detection sensor 32 according to the embodiment described above, a flow rate detection sensor may be provided for detecting the flow rate of air vented via the suction fan 29. When the interior of the negative-pressure chamber 31 is vented by the suction fan 29, the vented air flow rate decreases along with the decrease in pressure, and the pressure in the negative-pressure chamber 31 can therefore be estimated based on the vented air flow rate detected by the flow rate detection sensor.

A long, rectangular plastic film or the like may also be used as the recording medium.

In the embodiment described above, the recording device was specified as an inkjet printer, but the recording device is not limited thereto and can also be specified as a liquid ejection device which ejects or discharges a liquid other than ink (including liquid substances in which particles of a functional material are dispersed or mixed in a liquid, and fluid substances such as gels).

For example, the recording device may be a liquid ejection device which ejects a liquid (a liquid substance) containing an electrode material, a coloring material (pixel material), or another material in the form of a dispersion or a solvent, which is used in the manufacture of liquid crystal displays, electroluminescence (EL) displays, surface-emitting displays, and the like; a liquid ejection device which ejects a biological organic substance used to manufacture biochips; or a liquid ejection device which is used as a precision pipette and which ejects a liquid as a test sample. The recording device may also be a liquid ejection device which ejects lubricating oil at pinpoints onto a watch, a camera, or another precision instrument; a liquid ejection device for ejecting an ultraviolet curing resin or another transparent resin liquid onto a substrate in order to form a microscopic semispherical lens (optical lens) or the like used in an optical communication element or the like; a liquid ejection device for ejecting an acid, an alkali, or another etching liquid in order to etch a substrate or the like; or a liquid ejection device for ejecting a gel (e.g. a physical gel) or another liquid (fluid substance). The present invention can be applied to any of these liquid ejection devices.

A recording device according to the illustrated embodiment includes a medium-supporting part, a recording processing part, a suction device, and a control part. The medium-supporting part is configured and arranged to support a recording medium on a medium-supporting surface having a plurality of suction holes. The recording processing part is configured to perform recording process for recording on the recording medium supported on the medium-supporting part. The suction device is connected to the medium-supporting part, and configured and arranged to apply a suction force to the recording medium via the suction holes. The control part is configured to control operations of the suction device to set the suction force to a first suction force before the recording medium is supplied to the medium-supporting part, to change the suction force to a second suction force greater than the first suction force after the recording medium is supplied to the medium-supporting part, and to reduce the suction force below the second suction force during the recording process of recording on the recording medium, which has stopped on the medium-supporting surface, so that the suction force is reduced to the first suction force before the recording medium is conveyed.

According to this device, wrinkles and the like in the recording medium are eliminated and flatness is ensured in the conveying support surface by causing the suction device to apply a second suction force on the recording medium stopped on the medium-supporting surface, the second suction force being greater than the first suction force used when the recording medium is conveyed. Consequently, the printing process can be performed on a recording medium in which flatness is maintained, therefore making high-quality printing possible.

The recording medium can be conveyed smoothly because the recording medium is conveyed after the suction force of the suction device has been reduced from the second suction force to the first suction force after the printing process has ended. In this device, since the suction force of the suction device is reduced from the second suction force before the printing process ends, the recording medium can be conveyed immediately after the printing process ends.

In the recording device as described above, the suction device preferably includes a fan, and the control part is preferably configured to reduce a rotational speed of the fan before the recording process ends.

According this configuration, setting the suction force is readily accomplished.

The recording device as described above preferably further includes a pressure detection part connected to the medium-supporting part, and the control part is preferably configured to confirm that a detection result from the pressure detection part after the recording process has ended is a pressure value substantially equal to the first suction force.

According to this configuration, by initiating conveying of the recording medium after the detection result from the pressure detection part after the recording process has ended is confirmed to be a pressure substantially equal to the first suction force, the recording medium can be conveyed quickly without being subjected to any stress.

According to the illustrated embodiment, a method is provided for controlling a recording device having a medium-supporting part for supporting a recording medium on a medium-supporting surface having a plurality of suction holes, a recording processing part for performing recording process for recording on the recording medium supported on the medium-supporting part, a suction device for applying a suction force to the recording medium via the suction holes, a pressure detection part connected to the medium-supporting part, and a control part for controlling operations of the suction device based on a detection result from the pressure detection part. The method for controlling a recording device includes: conveying the recording medium using the suction force of the suction device with a first suction force; causing the recording medium supplied to the medium-supporting part to stop on the medium-supporting surface; changing the suction force of the suction device to a second suction force greater than the first suction force, and performing the recording process for recording on the recording medium stopped on the medium-supporting surface; and reducing the suction force of the suction device below the second suction force during the recording process so that the suction force reaches the first suction force, and subsequently conveying the recording medium.

According to this method, wrinkles and the like in the recording medium are eliminated and flatness is ensured in the conveying support surface by causing the suction device to apply a second suction force on the recording medium stopped on the medium-supporting surface, the second suction force being greater than the first suction force used when the recording medium is conveyed. Consequently, the printing process can be performed on a recording medium in which flatness is maintained, therefore making high-quality printing possible.

The recording medium can be conveyed smoothly because the recording medium is conveyed after the suction force of the suction device has been reduced from the second suction force to the first suction force after the printing process has ended. In this device, since the suction force of the suction device is reduced from the second suction force before the printing process ends, the recording medium can be conveyed immediately after the printing process ends.

In the method as described above, the reducing of the suction force during the recording process preferably includes reducing a rotational speed of a fan used as the suction device.

According to this method, setting the suction force is easy.

The method as described above preferably further includes confirming that the detection result from the pressure detection part is a pressure value substantially equal to the first suction force after the recording process is performed on the recording medium and before the recording medium is conveyed.

According to this method, by initiating conveying of the recording medium after the detection result from the pressure detection part is confirmed to be a pressure substantially equal to the first suction force after the recording process has ended, the recording medium can be conveyed quickly while not undergoing any stress.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a medium-supporting part having a suction hole;

a recording head configured and arranged to perform a liquid ejection onto a medium supported on the medium-supporting part;

a suction part connected to the medium-supporting part to suck outside air via the suction hole;

a conveying part configured and arranged to intermittently convey the medium; and a control part configured and arranged to control the suction part in each period, wherein a conveying period, during which the medium is conveyed by the conveying part, has a period in which the suction part sucks by a first suction force, and a liquid ejection period, during which the recording head performs the liquid ejection onto a predetermined area of the medium and the medium is not conveyed by the conveying part, has a period in which the suction part sucks by a second suction force which is greater than the first suction force after the conveying period so that the second suction force is applied to the medium, and a period in which the suction part sucks by a suction force which is smaller than the second suction force so that the suction force applied to the medium is reduced from the second suction force toward the first suction force.

2. The recording device according to claim 1, wherein the recording head is configured and arranged to perform the liquid ejection onto a predetermined area of the medium when the medium is not conveyed by the conveying part.

3. The recording device according to claim 1, wherein the suction force has been set smaller than the second suction force when the medium is conveyed by the conveying part.

4. The recording device according to claim 1, wherein the suction force is configured to be modified based on a data inputted to the control part.

5. The recording device according to claim 1, wherein the conveying part does not convey the medium while the recording head performs the liquid ejection onto the medium.

6. The recording device according to claim 5, wherein the conveying part is configured and arranged to reduce a tensile force applied to the medium after the suction part starts sucking by the second suction force in the period of the liquid ejection period in which the suction part sucks by the second suction force.

7. A recording device comprising:

a medium-supporting part having a suction hole;

a recording head configured and arranged to perform a liquid ejection onto a medium supported on the medium-supporting part;

a suction part connected to the medium-supporting part to suck outside air via the suction hole; and a control part configured and arranged to control the suction part in each period, wherein a liquid ejection period, during which the recording head performs the liquid ejection onto a predetermined area of the medium, has a first period in which the suction part sucks by a prescribed suction force so that the prescribed suction force is applied to the medium, and a second period in which the suction part sucks by a suction force which is smaller than the prescribed suction force after the first period so that the suction force smaller than the prescribed suction force is applied to the medium, the period being a last period of the liquid ejection period.

8. A recording device comprising:

a medium-supporting part having a suction hole;

a recording head configured and arranged to perform a liquid ejection onto a medium supported on the medium-supporting part;

a suction part connected to the medium-supporting part to suck outside air via the suction hole; and a control part configured and arranged to control the suction part in each period, wherein a liquid ejection period, during which the recording head performs the liquid ejection onto a predetermined area of the medium, has a first period in which the suction part sucks by a prescribed suction force so that the prescribed suction force is applied to the medium, and a second period in which the suction part sucks by a suction force which is smaller than the prescribed suction force after the first period so that the suction force smaller than the prescribed suction force is applied to the medium, the suction part includes a fan, and a rotational speed of the fan is reduced compared to the first period of the liquid ejection period before the liquid ejection period ends.

9. The recording device according to claim 8, further comprising a chamber having airtight space with a ceiling of the chamber defining the medium supporting part, and the fan is configured and arranged to suction out the air in the chamber to create negative pressure.

10. A method for controling a recording device, the method comprising:

performing a liquid ejection by a recording head onto a medium supported on a medium-supporting part having a suction hole;

sucking outside air by a suction part connected to the medium-supporting part via the suction hole of the medium-supporting part;

intermittently conveying the medium by a conveying part; and controlling the suction part in each period by a control part, wherein a conveying period, during which the medium is conveyed by the conveying part, has a period in which the suction part sucks by a first suction force, and a liquid ejection period, during which the recording head performs the liquid ejection onto a predetermined area of the medium and the medium is not conveyed by the conveying part, has a period in which the suction part sucks by a second suction force which is greater than the first suction force after the conveying period so that the second suction force is applied to the medium, and a period in which the suction part sucks by a suction force which is smaller than the second suction force so that the suction force applied to the medium is reduced from the second suction force toward the first suction force.

11. A method for controling a recording device, the method comprising:

performing a liquid ejection by a recording head onto a medium supported on a medium-supporting part having a suction hole;

sucking outside air by a suction part connected to the medium-supporting part via the suction hole of the medium-supporting part; and controlling the suction part in each period by a control part, wherein a liquid ejection period, during which the recording head performs the liquid ejection onto a predetermined area of the medium, has a first period in which the suction part sucks by a prescribed suction force so that the prescribed suction force is applied to the medium, and a second period in which the suction part sucks by a suction force which is smaller than the prescribed suction force after the first period so that the suction force smaller than the prescribed suction force is applied to the medium, the second period being a last period of the liquid ejection period.

12. A method for controling a recording device, the method comprising:

performing a liquid ejection by a recording head onto a medium supported on a medium-supporting part having a suction hole;

sucking outside air by a suction part connected to the medium-supporting part via the suction hole of the medium-supporting part; and controlling the suction part in each period by a control part, wherein a liquid ejection period, during which the recording head performs the liquid ejection onto a predetermined area of the medium, has a first period in which the suction part sucks by a prescribed suction force so that the prescribed suction force is applied to the medium, and a second period in which the suction part sucks by a suction force which is smaller than the prescribed suction force after the first period so that the suction force smaller than the prescribed suction force is applied to the medium, the suction part includes a fan, and a rotational speed of the fan is reduced compared to the first period of the liquid ejection period before the liquid ejection period ends.

* * * * *